US006402481B1

(12) United States Patent
Ahn

(10) Patent No.: US 6,402,481 B1
(45) Date of Patent: Jun. 11, 2002

(54) VARIABLE CAPACITY SWASH PLATE TYPE COMPRESSOR

(75) Inventor: Hew Nam Ahn, Taejon (KR)

(73) Assignee: Halla Climate Control Corp., Taejon (KR)

( * ) Notice: Subject to any disclaimer, the term of this patent is extended or adjusted under 35 U.S.C. 154(b) by 0 days.

(21) Appl. No.: 09/643,987

(22) Filed: Aug. 22, 2000

(30) Foreign Application Priority Data

Dec. 16, 1999 (KR) ..... 99-58104

(51) Int. Cl.[7] ..... F04B 1/26; F01B 3/00

(52) U.S. Cl. ..... 417/222.2; 417/269; 92/12.2

(58) Field of Search ..... 92/12.2, 71; 417/222.1, 417/222.2, 269

(56) References Cited

U.S. PATENT DOCUMENTS

| | | | | |
|---|---|---|---|---|
| 4,175,915 A | | 11/1979 | Black et al. | 417/222 |
| 4,664,604 A | | 5/1987 | Terauchi | 417/222 |
| 5,105,728 A | | 4/1992 | Hayase et al. | 92/71 |
| 6,139,282 A | * | 10/2000 | Ota et al. | 417/222.2 |
| 6,179,571 B1 | * | 1/2001 | Kawachi et al. | 417/222.1 |
| 6,260,469 B1 | * | 7/2001 | Ahn | 92/71 |

FOREIGN PATENT DOCUMENTS

| | | |
|---|---|---|
| EP | 0775824 A1 | 5/1997 |
| EP | 0869281 A2 | 10/1998 |

* cited by examiner

*Primary Examiner*—Charles G. Freay
(74) *Attorney, Agent, or Firm*—Klauber & Jackson

(57) ABSTRACT

The present invention relates to a variable capacity swash plate type compressor. The present invention is provided a variable capacity swash plate type compressor comprising: a housing means having a cylinder block with a plurality of cylinder bores formed therein and enclosing therein a crank chamber, a suction chamber, and a discharge chamber; a drive shaft rotatably supported by the housing means; a plurality of pistons reciprocatively disposed in each of the cylinder bores; a rotor mounted on the drive shaft so as to rotate together with said drive shaft in the crank chamber; a swash plate operatively connected to the rotor via a hinge means and slidably mounted on the drive shaft to thereby change an inclination angle thereof in response to changes of pressure in the crank chamber; a motion conversion means disposed between the swash plate and the pistons for converting rotation of the swash plate into reciprocation of the pistons in the respective cylinder bores; and a control valve means for changing a pressure level in the crank chamber; the hinge means including a support arm protruding from the rotor toward the swash plate, an arm having one end extending from the swash plate, and a pin means supported by the other end of the arm; and, the support arm having a recess with a depth being able to receive a displacement due to change of the inclination angle of the swash plate from one end surface of the support arm, and the arm is movably coupled with the support arm by the pin means so that the pin means is slidable in the recess in compliance with the change of the inclination angle of the swash plate.

13 Claims, 4 Drawing Sheets

VARIABLE CAPACITY SWASH PLATE TYPE COMPRESSOR

BACKGROUND OF THE INVENTION

1. Field of the Invention

The present invention relates to a variable capacity swash plate type compressor adapted for use in an air conditioner for a vehicle, and more particularly to such compressor of an improved type which has a hinge mechanism for pivotally supporting a swash plate.

2. Description of the Related Art

In automotive air conditioners, a variable capacity swash plate type compressor is widely used, which generally comprises a drive shaft, a rotor or lug plate mounted on and rotating with the drive shaft, and a swash plate. The swash plate is rotatably disposed on a spherical outer surface of a spherical sleeve member slidably mounted on the drive shaft.

Between the rotor and the swash plate is arranged a hinge mechanism which normally includes a first arm member projecting from the rotor in the rear direction of the compressor, a second arm member projecting from the swash plate in the front direction of the compressor, and a pin member connecting the first and second arm members through a pair of holes each formed in the respective arm members. One of the holes, for example the hole formed in the rotor is elongated to guide the pin therein according to the change of inclination angle of the swash plate. The sliding motion of the pin within the elongated hole changes the inclination angle of the swash plate. The sliding motion of the pin within the elongated hole changes the inclination angle of the swash plate. The compressor also includes a plurality of pistons each engaged with the swash plate via semi-spherical shoes.

The hinge mechanism allows the swash plate to slide along and change its inclination angle with respect to the drive shaft. The hinge mechanism also allows the swash plate to rotate together with the drive shaft and the rotor. Rotation of the drive shaft causes the rotor and swash plate to rotate therewith, and accordingly, each pistion engaged with the swash plate reciprocates within respective cylinder bores so that suction and compression of the refrigerant gas are completed. The capacity of the compressor is controlled by changing the inclination angle of the swash plate according to the pressure difference between the pressure in the crank chamber and the suction pressure.

In the above described variable capacity swash plate type compressor, the swash plate rotates with the drive shaft and nutates back and forth with respect to the rotor, and the rotation of the swash plate is converted into the reciprocation of the pistons within the respective cylinder bores. A suction force acts on the swash plate from the pistons during the suction stroke while a compression reaction force also acts on the swash plate from the pistons during the compression stroke. Therefore, the swash plate is subject to a twisting motion or bending moment due to the suction and compression reaction forces acting from each piston on the swash plate. Moreover, since a torque exerted by the drive shaft is transmitted to the swash plate through the hinge mechanism, the swash plate is twisted with respect to the rotor in a direction different from the back and forth nutating motion.

As a solution for the above mentioned problems, U.S. Pat. No. 5,540,559 discloses a variable capacity compressor having an improved hinge unit. The hinge units comprise a pair of brackets protruding from the back surface of the rotary swash plate, a pair of guide pins each having one end fixed to each bracket and the other end fixed to a spherical element, and a pair of support arms protruding from the upper front surface of the rotor. Each support arm is provided with a circular guide hole into which the spherical element of the guide pin is rotatably and slidably inserted. U.S. Pat. No. 5,336,056 discloses a hinge means including two support arms extended axially rewardly from the rotary support. Each of the support arms has a through-bore in which a race member is fixedly seated to tunably receive a ball element. Each ball element, too, has formed therein a through-hole operative as a guide hole permitting an axial slide of a guide pin therin. The guide pins are fixedly press-fitted in two through-bores formed in the rotary drive element of the swash plate assembly, respectiverly.

However, the hinge mechanisms disclosed in the above U.S. Patents are complex, and in particular, they require precise and time-consuming machining to form the circular guide holes and spherical elements of the guide pins in U.S. Pat. No. 5,540,559 and to form through-bores in U.S. Pat. No. 5,336,056. Moreover, to make symmetrical the hinge mechanism including two support arms protruding from the rotor or the rotary drive element must be accurate and therefore is relatively burdensome. These raise the cost in manufacturing the compressor. Therefore, it is advantageous to provide a compressor with a hinge mechanism which is simple in its construction and machining thereof and prevents the twisting and bending of the swash plate.

SUMMARY OF THE INVENTION

An object of the present invention is, therefore, to provide a variable capacity swash plate type compressor which is free of the above-mentioned problems.

Another object of the present invention is to provide a variable capacity swash plate type compressor provided with a novel hinge mechanism which can be easily and inexpensively manufactured.

According to the present invention, there is provided a variable capacity swash plate type compressor comprising:

a housing means having a cylinder block with a plurality of cylinder bores formed therein and enclosing therein a crank chamber, a suction chamber, and a discharge chamber;

a drive shaft rotatably supported by said housing means a plurality of pistons reciprocatively disposed in each of said cylinder bores;

a rotor mounted on said drive shaft so as to rotate together with said drive shaft in said crank chamber;

a swash plate operatively connected to said rotor via a hinge means and slidably mounted on said drive shaft to thereby change an inclination angle thereof in response to changes of pressure in said crank chamber;

a motion conversion means disposed between said swash plate and said pistons for converting rotation of said swash plate into reciprocation of said pistons in the respective cylinder bores; and a control valve means for changing a pressure level in said crank chamber;

said hinge means including a support arm protruding from said rotor toward said swash plate, an arm having one end extending from said swash plate, and a pin means supported by the other end of said arm; and said support arm having a recess with a depth being able to receive a displacement due to change of the inclination angle of said swash plate from one end surface of said support arm, and said arm is movably coupled with said support arm by said pin means so that said pin means is slidable in said recess in compliance with the change of the inclination angle of said swash plate.

Other objects, features, and advantages of the present invention will be understood from the detailed description of the preferred embodiments of the present invention with reference to the accompanying drawings.

DETAILED DESCRIPTION OF THE PREFERRED EMBODIMENTS

Figure 1:
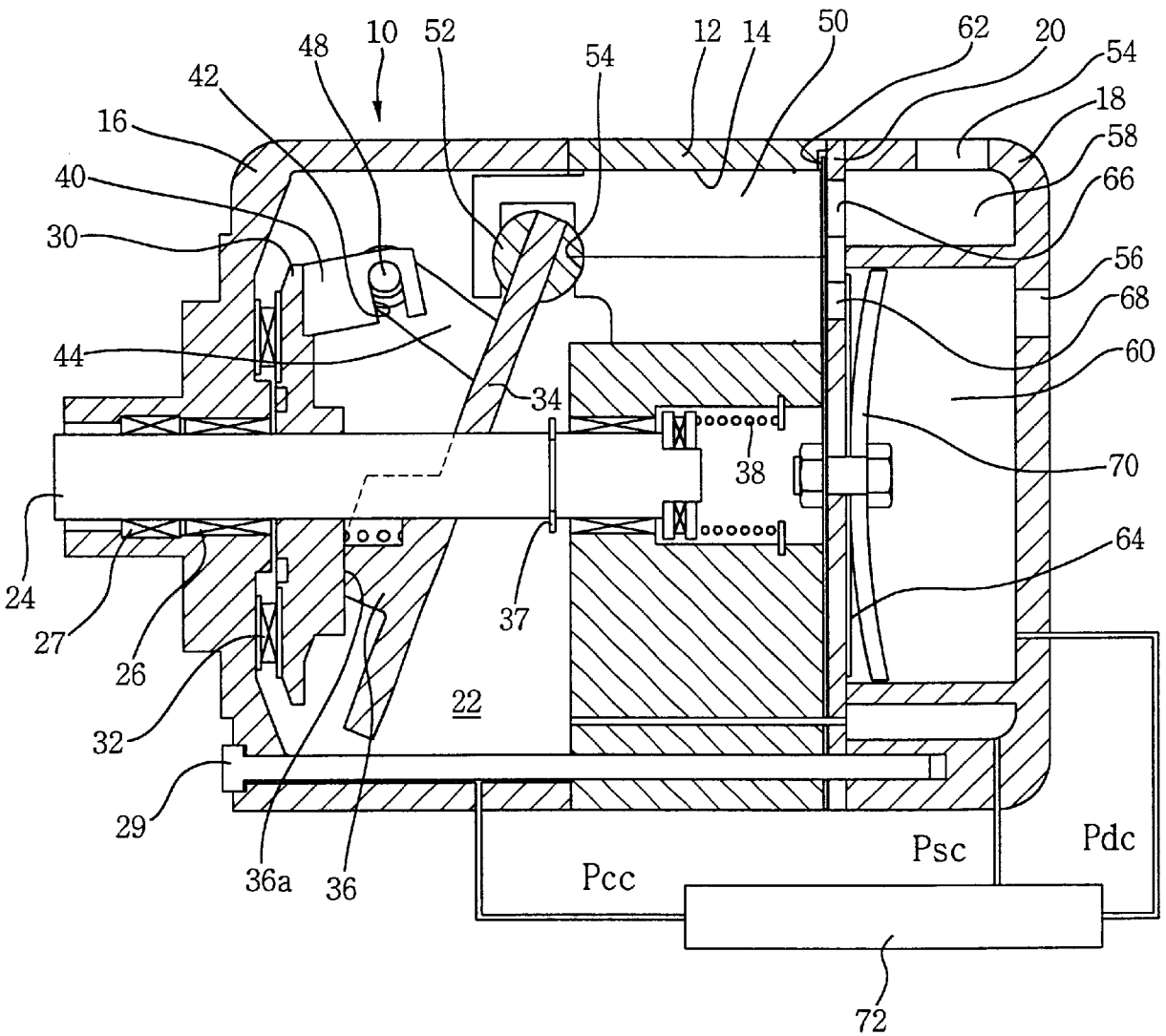
FIG. 1 is a longitudinal cross-sectional view of a variable capacity swash plate type compressor with a hinge means according to one embodiment of the present invention.
Figure 2:
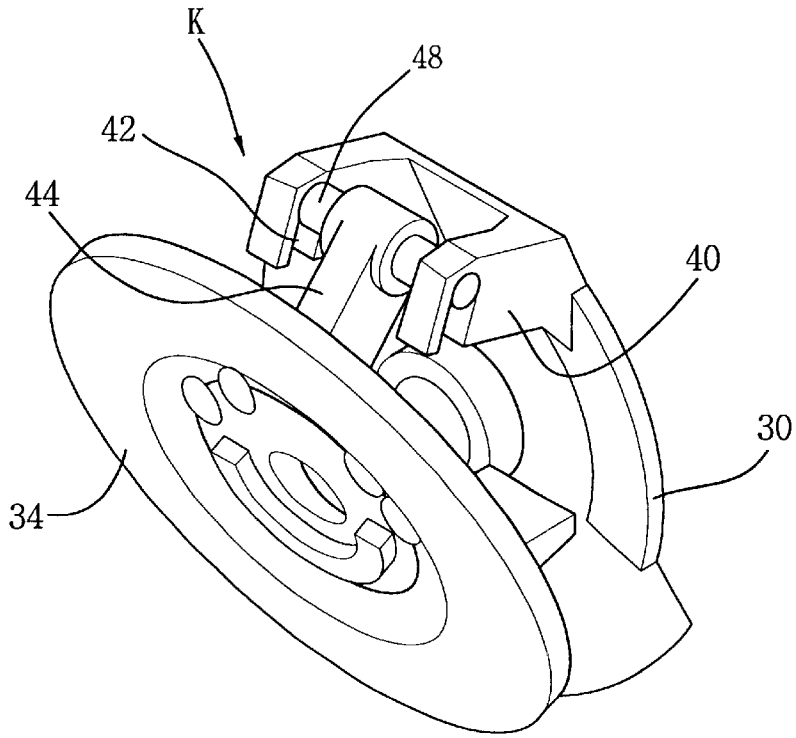
FIG. 2 is a perspective view showing the elements around a rotor in the compressor of FIG. 1.
Figure 3:
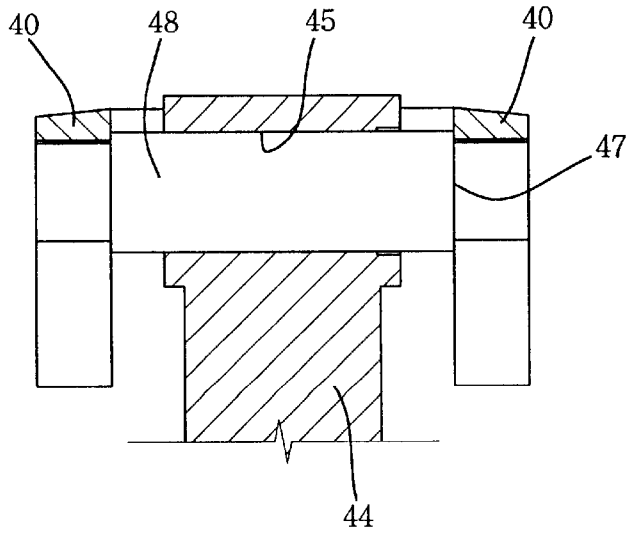
FIG. 3 is a partial cross-sectional view showing an assembled relation of a hinge means according to the present invention.

Referring to FIGS. 1 through 3, a variable capacity swash plate type compressor 10 has a cylinder block 12 provided with a plurality of cylinder bores 14, a front housing 16 and a rear housing 18. Both front and rear ends of the cylinder block 12 are sealingly closed by the front and rear housings 16 and 18, and a valve plate 20 is intervened between the cylinder block 12 and the rear housing 18. The cylinder block 12 and the front housing 16 define an air-tight sealed crank chamber 22. A drive shaft 24 is centrally arranged to extend through the front housing 16 to the cylinder block 12, and rotatably supported by radial bearings 26 and 27. The cylinder block 12 and the front and rear housings 16 and 18 are tightly combined by a long screw 29.

A rotor 30 is fixedly mounted on the drive shaft 24 within the crank chamber 22 to be rotatable with the drive shaft 24, and supported by a thrust bearing 32 seated on an inner end of the front housing 16. A swash plate 34 is rotatably supported on the drive shaft 24. A spherical sleeve can be intervened between the drive shaft 24 and the swash plate 34, and in this case, the swash plate 34 is rotatably supported on an outer support surface of the spherical sleeve. In FIG. 1, the swash plate 34 is in its largest inclination angle position, and at this time, a spring 38 is most compressed and a stop surface 36*a* of a projection 36 comes into contact with the rotor 30 so that a further increase of inclination angle of the swash plate 34 is restricted by the rotor 30. On the other hand, a further decrease of inclination angle of the swash plate 34 is restricted by a stopper 37 provided with the drive shaft 24.

As shown well in FIGS. 2 and 3, a hinge means or hinge mechanism designated by "K" includes a pair of support arms 40 protruding from an upper front surface of the rotor 30 in the rear direction of the drive shaft 24, an arm 44 protruding from an upper back surface of the swash plate 34 toward the support arms 40, and a pin 48 extending across the arm 44. A rectangular or arc shaped recess 42 to guide the movement of the pin 48 is linearly formed around a free end of each support arm 40 in such a manner that the two recesses 42 formed in each support arm are opposed to each other in a parallel relation. Each recess 42 extends from the corresponding bottom surface of the support arms 40 toward the upper direction, and both opposed ends of each recess are open ended. The recesses 42 are also arranged in such a manner that the recesses 42 are formed along the loci connecting a pair of predetermined positions, at which both ends of the pin 48 in the arm 44 come into contact with the support arms 40 when a piston 50 is positioned at its top dead center and the swash plate 34 is in its largest inclination angle position, and another pair of predetermined positions, at which both ends of the pin 48 come into contact with the support arms 40 when a piston 50 is positioned at its top dead center and the swash plate 34 is in its smallest inclination angle position. The recesses 42 are symmetrically opposed with each other, and the depth of each recess 42 is defined to sufficiently receive the displacement of the swash plate from the smallest inclination angle position to the largest inclination angle position. In this manner, the support arms 40 and arm 44 are slidably connected to each other by the pin 48. In this construction, the drive shaft 24 is arranged so as to be remotely interposed between the two support arms 40 when viewing over the compressor 10.

In the above-described construction, the support arms 40 and arm 44 are formed in the rotor 30 and swash plate 34, respectively, but to the contrary, the support arms 40 may be formed in the swash plate 34 and the arm 44 in the rotor 30.

The pin 48 is able to be manufactured to have various shapes as long as it is able to guide the displacement of the swash plate 34 according to the changes in the inclination angle. Preferably, the pin 48 has a cylindrical shape to allow the friction due to the contact between the inside surfaces of the recesses 42 and the pin 48 to be minimized. As shown well in FIG. 3, the pin 48 includes at least one stepped portion 47 which is formed in one end portion of the pin 48 and has a smaller diameter than the central portion of the pin 48. When the stepped portion 47 is formed in one end portion thereof, it is provided toward the direction to which the rotation of the swash plate 34 is applied. The stepped portion 47 of the pin 48 allows the rotation of the drive shaft 24 to be transmitted finally to the swash plate 34 by means of the contact between the stepped surface of the stepped portion 47 and the inside surface around the recess 42 in the support arm 40.

Figure 4:
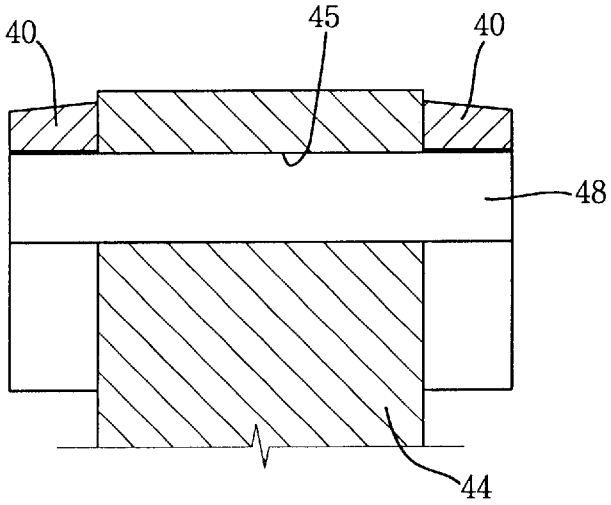
FIG. 4 is a partial cross-sectional view showing an assembled relation of a hinge means according to another embodiment of the present invention.

Unlike the embodiment in FIGS. 2 and 3 in which the stepped portion 47 is formed in the pin 48 as a means to transmit the rotational force of the drive shaft 24 to the swash plate 34 via the rotor 30, the rotational force of the drive shaft 24 is able to be transmitted with the uniform diameter of the pin 48 without forming the stepped portion 47. As shown in FIG. 4, at least one side surface of the arm 44 comes into surface contact with the inside surface of one of the support arms 40 in a direction of the rotation of the swash plate 34 so as to transmit the rotation of the drive shaft 24 to the swash plate 34. Both ends of the arm 44 come into close contact with the inside surfaces of the support arms 40.

The pin 48 is coupled with the arm 44 of the swash plate 34 by inserting the pin 48 into a through-bore 45 formed in the arm 44. Alternatively, the arm 44 and the pin 48 are formed together. In addition, a single support arm 40 protruding from the rotor 30 may be formed, and in this case, the support arm 40 and the arm 44 are coupled with each other by the pin 48 which is, in turn, fixed by a means such as bolts and nuts.

By the hinge means "K", the rotor 30 and the swash plate 34 are hinged to each other, and therefore, when the rotor 30 is rotated by rotation of the drive shaft 24, the swash plate 34 is also rotated. Upward and downward movement of the pin 48 along the recesses 42 of the support arms 40 therewithin allows the swash plate 34 to slide along and incline with respect to the drive shaft 24. Namely, the inclination angle of the swash plate 34 is adjusted with respect to an imaginary plane perpendicular to the axis of the drive shaft 24.

As shown in FIG. 1, inner flat surfaces of semi-spherical shoes 52 come into contact with the outer peripheral portion of the swash plate 34, and outer semi-spherical surfaces of the shoes 52 are slidably engaged with shoe pockets 51 formed in the respective pistons 50. With this arrangement, a plurality of pistons 50 are engaged with the swash plate 34 via the shoes 52, and the pistons 50 reciprocate within the respective cylinder bores 14 in response to the rotation of the swash plate 34. That is, the shoes 52 serve as a motion conversion means for converting rotation of the swash plate 34 into reciprocation of each piston 50.

The rear housing 18 is provided with inlet and outlet ports 54 and 56, and divided into suction and discharge chambers 58 and 60. The valve plate 20 has suction and discharge ports 66 and 68. Each cylinder bore 14 is communicated with the suction chamber 58 and the discharge chamber 60 via the suction ports 66 and the discharge ports 68. Each suction port 66 is opened and closed by a suction valve 62, and each discharge port 68 is opened and closed by a discharge valve 64, in response to the reciprocal movement of the respective pistons 50. The opening motion of the discharge valve 64 is restricted by a retainer 70.

A control valve means 72 is provided with the compressor 10 for adjusting a pressure level within the crank chamber 22 as shown in FIG. 1.

Figure 5:
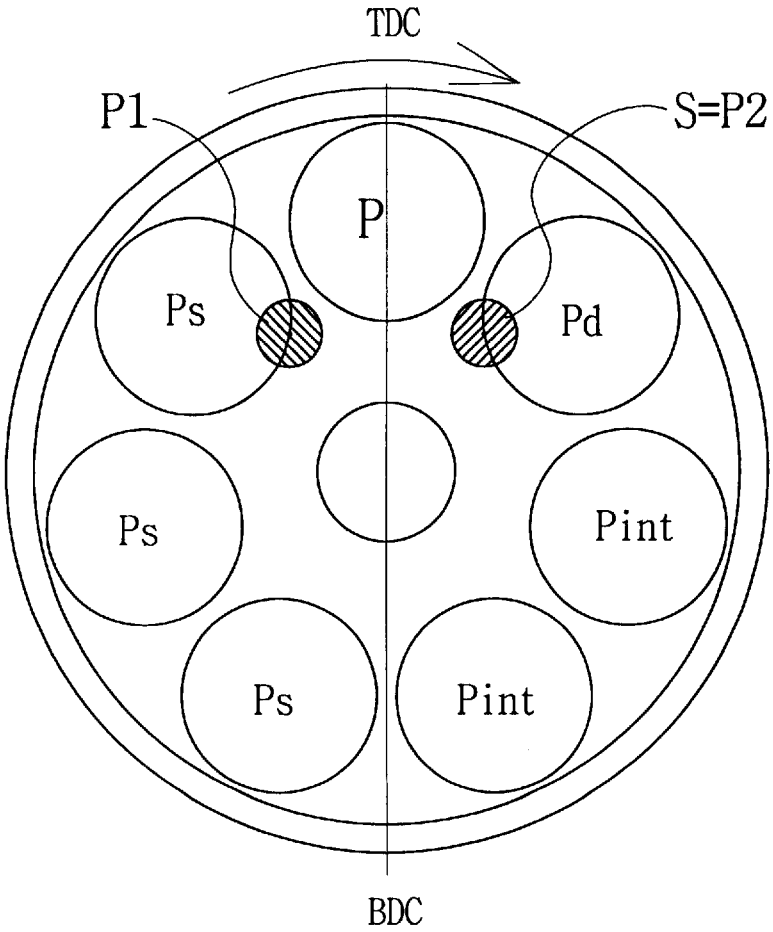
FIG. 5 shows a position on which the sum of the suction and compression reaction forces acts when suction and compression of a refrigerant gas occur.
Figure 6:
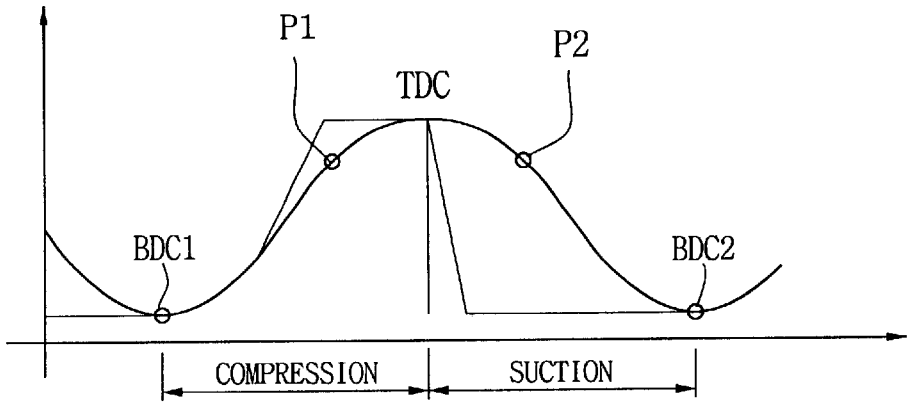
FIG. 6 is a diagrammatical view illustrating a relationship between the time and the position of a piston and the pressure in a cylinder.

Turning to FIGS. 5 and 6, the operating point of the resultant force of suction and compression reaction forces acting on the swash plate 34 is shifted from a position "P", at which the swash plate 34 is engaged with one of the pistons 50 moved in the cylinder bore 14 to the top dead center "TDC" thereof, to a position "S" in a right direction with respect to the rotational direction of the swash plate 34. When seven pistons, for example, reciprocate in the respective cylinder bores 14 in response to the rotation of the swash plate 34, with respect to the rotational direction of the swash plate 34 compression reaction forces Pd and Pint act on the swash plate 34 in the right half portion therof while suction forces Ps act on the swash plate 34 in the left half portion thereof. At this time, the relation between the forces in their strength is Pd>Pint>Ps. When each of the pistons 50 approaches to the top dead center "TDC" thereof during the reciprocation thereof, the discharge of the compressed refrigerant gas from the corresponding cylinder bore 14 into the discharge chamber 60 is completed. And when the movement of the piston just having completed the discharge is reversed from the top dead center "TDC" to the bottom dead center "BDC1", the suction of the refrigerant gas before compression is subsequently carried out for a time between the top dead center "TDC" and the bottom dead center "BDC2". When each of the pistons 50 moves between the bottom dead center "BDC1" and the top dead center "TDC", the compression reaction force of the refrigerant gas acts on the swash plate 34, while when the piston 50 moves between the top dead center "TDC" and the bottom dead center "BDC2", the suction force acts on the swsh plate 34. Therefore, the resultant force of the compression reaction and suction forces applied to the swash plate 34 via the pistons 50 moves from the predetermined position "P" which lies on the center line of the swash plate 34, i.e., at which the swash plate 34 is engaged with the pistion 50 moved in the cylinder bore 14 thereof to the top dead center "TDC" thereof, to the right position "S" with respect to the rotational direction of the swash plate 34. The broken lines designate the pressure level within each cylinder bore 14.

In the compressor having the above-described construction, when the drive shaft 24 is rotated, the swash plate 34 having a certain inclination angle is also rotated via the hinge means K, and thus the rotation of the swash plate 34 is converted into the reciprocation of the pistons 50 within the respective cylinder bores 14 via the shoes 52. This reciprocating motion causes the refrigerant gas to be introduced from the suction chamber 58 of the rear housing 18 into the respective cylinder bores 14 in which the refrigerant gas is compressed by the reciprocating motion of the pistons 50. The compresed refrigerant gas is discharged from the respective cylinder bores 14 into the discharge chamber 60.

At this time, the capacity of the compressed refrigerant gas discharged from the cylinder bores 14 into the discharge chamber 60 is controlled by the control valve means 72 which adjustably changes the pressure level within the crank chamber 22. Namely, when the pressure level Psc in the suction chamber 58 is raised with increase of the thermal load of an evaporator, the control valve means 72 cuts off the refrigerant gas travelling from the discharge chamber 60 into the crank chamber 22 so that the pressure level Pcc in the crank chamber 22 is lowerd. When the pressure level in the crank chamber 22 is lowered, a back pressure (crank chamber pressure Pcc) acting on the respective pistons 50 is decreased, and therefore, the angle of inclination of the swash plate 34 is increased. Namely, the pin 48 of the hinge means K in contact at both ends thereof with the recesses 42 slides along the recesses 42 of the support arms 40 toward the inner direction of the recesses 42 (the upper direction in FIG. 1). Accordingly, the swash plate 34 is moved in a forward direction against the force of the spring 38. Therefore, the angle of inclination of the swash plate 34 is increased, and as a result, the stroke of the respective pistons 50 is increased and the discharge capacity is increased.

On the contrary, when the pressure level Psc in the suction chamber 58 is lowered with decrease of the thermal load of the evaporator, the control valve means 72 passes the compressed refrigerant gas of the discharge chamber 60 into the crank chamber 22. When the pressure level in the crank chamber 22 is raised, a back pressure (crank chamber pressure Pcc) acting on the respective piston 50 is increased, and therefore, the angle of inclination of the swash plate 34 is decreased. Namely, the pin 48 of the hinge means K in contact at both ends thereof with the recesses 42 slides along the recesses 42 of the support arms 40 toward the opened outer direction of the recesses 42 (the lower direction in FIG. 1). Accordingly, the swash plate 34 is moved in a reward direction yielding to the force of the spring 38. Therefore, the inclination angle of the swash plate 34 is decreased, and as a result, the stroke of the respective pistons 50 is shortened and the discharge capacity is decreased.

Referring to FIGS. 5 and 6 again, in the compressor with the above-described construction, when operation of the compressor the suction force acts on about the left half portion of the swash plate 34 via the pistons 50. On the other hand, the compression reaction force acts on about the right half portion of the swash plate 34 via the pistons 50. One of the two support arms 40 in the rotor 30 is disposed on a position in the rotor 30 opposed to the position "S=P2" and the other of the support arms 40 is disposed on a position in the rotor 30 opposed to the position "P1", while the arm 44 in the swash plate 34 is placed on the center line of the swash plate 34. With this construction, the hinge means K prevents the bending moment applied to the swash plate 34 and, therefore, reduces a force exerted on the drive shaft 24 from the swash plate 34. Since one of the support arms 40 of the hinge means K is disposed on the left position P1 with respect to the top dead center TDC and the other is disposed on the right position P2 with respect to the top dead center TDC, the suction and compression reaction forces are supported and absorbed by the hinge means of the support arms 40, arm 44 and pin 48. Therefore, the swash plate 34 can be prevented from being twisted around an axis perpendicular to the drive shaft 24 and from being subject to a bending moment around the above axis.

Figure 7:
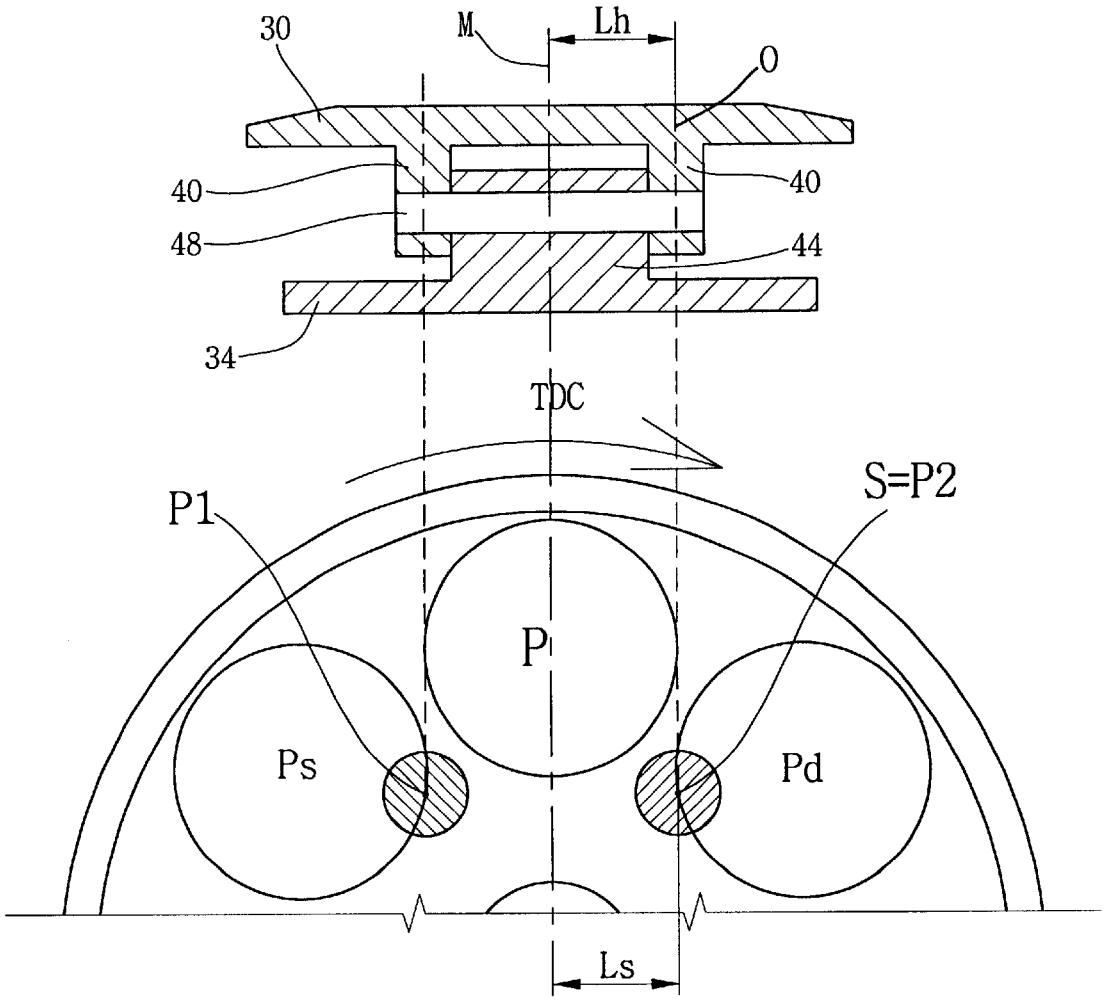
FIG. 7 shows a relationship between the operating point of sum of suction and compression reaction forces and the positions of support arms of the rotor.

Now referring to FIG. 7, the support arms 40 may have their central axes locating in outsides of the positions P1 and P2, respectively, as the next best way, although the support arms 40 are most preferable to being symmetrically formed in the respective positions P1 and P2 as described above. That is to say, the support arms 40 is able to be placed to meet $$Lh \geqq Ls$$

where Lh is the horizontal distance between a plane M passing through the top dead cender TDC and the central axis of one of the support arms 40, and Ls is the horizontal distance between the plane M and one of the positions P1 and P2, for example, the position P2 which is the operating point of the resultant force. If Lh<Ls, the support of the swash plate 34 becomes unstable so as to cause damage to the swash plate 34 because of a strong bending moment acting on a half portion of the swash plate 34 (the right half portion in FIG. 5).

Biased abrasion of the surfaces of the recesses 42 caused by the exertion of the suction and compression reaction forces is able to be prevented because both end surfaces of the pin 48 come into surface contact with the respective surfaces of the recesses 42 of the support arms 40.

Although the present invention has been described in connection with the preferred embodiments, the invention is not limited thereto. It will be easily understood by those skilled in the art that variations and modifications can be easily made within the scope of the present invention as defined by the appended claims.

What is claimed is:

1. A variable capacity swash plate type compressor comprising:

a housing having a cylinder block with a plurality of cylinder bores formed therein and enclosing therein a crank chamber, a suction chamber, and a discharge chamber;

a drive shaft rotatably supported by said housing;

a plurality of pistons reciprocatively disposed in each of said cylinder bores;

a rotor mounted on said drive shaft so as to rotate together with said drive shaft in said crank chamber;

a swash plate operatively connected to said rotor via a hinge and slidably mounted on said drive shaft to thereby change an inclination angle thereof in response to changes of pressure in said crank chamber;

a motion conversion means disposed between said swash plate and said pistons for converting rotation of said swash plate into a reciprocation of said pistons in the respective cylinder bores; and a control valve for changing a pressure level in said crank chamber;

said hinge including a support arm protruding from said rotor toward said swash plate, a swash plate arm having one end extending from said swash plate, and a pin supported by the other end of said swash plate arm; and said support arm having a slot-shaped recess for receiving a displacement due to change of the inclination angle of said swash plate from one end surface of said support arm, and said swash plate arm is movably coupled with said support arm by said pin, so that said swash plate is slidable in said recess in compliance with the change of the inclination angle of said swash plate, wherein said pin includes a cylindrical pin provided with at least one stepped portion formed at one end portion of said pin, and the surface of said stepped portion comes into slidable contact with a surface around the recess of said support arm, so as to transmit the rotation of said drive shaft to said swash plate.

2. The compressor of claim 1, wherein said support arm includes a pair of a first support arm and a second support arm, each having a recess with a depth being able to receive the displacement due to change of the inclination angle of said swash plate from one end surface of the support arm, and said swash plate arm is movably coupled between said pair of said first and second support arms by said pin so that said pin is slidable in the recesses in compliance with the change of the inclination angle of said swash plate.

3. The compressor of claim 2, wherein said pin includes a second stepped portion formed at the other end portion of said pin, and said second stepped surface of said second stepped portion comes into slidable contact with a surface of said recess so as to transmit the rotation of said drive shaft to said swash plate.

4. The compressor of claim 2, wherein said swash plate arm of said swash plate comes into surface contact with one of said pair of said first and second support arms of said rotor to transmit the rotation of said drive shaft to said swash plate.

5. The compressor of claim 4, wherein said swash plate arm of said swash plate at both sides comes into contact with said pair of said first and second support arms therebetween.

6. The compressor of claim 3, wherein said pin is formed integrally with said swash plate arm of said swash plate.

7. The compressor of claim 2, wherein said recesses are arranged in the respective support arms in such a manner that said recesses are formed along loci connecting a pair of predetermined positions, at which both ends of said pin come into contact with said support arms when one of said pistons is positioned at its top dead center and the swash plate is in its largest inclination angle position, and another pair of predetermined positions at which said both ends of said pin come into contact with said support arms when said one of said pistons is positioned at its top dead center and said swash plate is in its smallest inclination angle position.

8. The compressor of claim 2, wherein one of said support arms is disposed on a corresponding position in said rotor opposed to an operating position on which a resultant force of suction and compression reaction forces applied to said swash plate acts, and the other is disposed on a corresponding position in said rotor opposed to a position, which, in turn, opposed to said operating position, and wherein said swash plate arm of said swash plate is disposed between said support arms.

9. The compressor of claim 2, wherein one of said support arms is disposed on a corresponding position in said rotor opposed to a first position in said swash plate satisfying a condition of Lh>Ls, in which Lh is a horizontal distance between a plane passing through a top dead center of one of said pistons and a central axis of one of said support arms, and Ls is a horizontal distance between said plane and an operating point on which a resultant force of suction and compression reaction forces applied to said swash plate acts, and the other of said support arms is disposed on a corresponding position in said rotor opposed to said first position, and wherein said swash plate arm of said swash plate is disposed between said support arms.

10. The compressor of claim 1, wherein said support arm includes a pair of arms, and said support arm is movably coupled between said pair of arms by said pin, so that said pin is slidable in said recess in compliance with the change of the inclination angle of said swash plate.

11. A variable capacity swash plate type compressor comprising:

a housing having a cylinder block with a plurality of cylinder bores formed therein and enclosing therein a crank chamber, a suction chamber, and a discharge chamber;

a drive shaft rotatably supported by said housing;

a plurality of pistons reciprocatively disposed in each of said cylinder bores;

a rotor mounted on said drive shaft so as to rotate together with said drive shaft in said crank chamber;

a swash plate operatively connected to said rotor via a hinge and slidably mounted on said drive shaft to thereby change an inclination angle thereof in response to changes of pressure in said crank chamber;

a motion conversion means disposed between said swash plate and said pistons for converting rotation of said swash plate into reciprocation of said pistons in the respective cylinder bores;

a control valve for changing a pressure level in said crank chamber;

said hinge including a pair of arms protruding from said swash plate toward said rotor, a support arm having one end extending from said rotor, and a pin supported by the other end of said support arm;

said support arms having a recess for receiving a displacement due to change of the inclination angle of said swash plate from one end surface of the arm, and said support arm is coupled with said pair of arms by said pin, so that said pin is slidable in the recesses in compliance with the change of the inclination angle of said swash plate, wherein said pin includes a cylindrical pin provided with at least one stepped portion formed at one end portion of said pin, and the surface of said stepped portion comes into slidable contact with a surface of the recess of said support arm, so as to transmit the rotation of said drive shaft to said swash plate.

12. The compressor of claim 11, wherein said support arm comes into surface contact with one of said pair of arms of said swash plate to transmit the rotation of said drive shaft to said swash plate.

13. The compressor of claim 11, wherein one of said arms is disposed on a first position in said swash plate satisfying a condition of Lh≧Ls, in which Lh is a horizontal distance between a plane passing through a top dead center of one of said pistons and a central axis of one of said arms, and Ls is a horizontal distance between said plane and an operating point on which a resultant force of suction and compression reaction forces applied to said swash plate acts, and the other of said arms is disposed on a position in said swash plate opposed to said first position, and wherein said support arm of said rotor is disposed between said arms.

* * * * *